US006852275B2

(12) United States Patent
Kida

(10) Patent No.: US 6,852,275 B2
(45) Date of Patent: Feb. 8, 2005

(54) PROCESS FOR PRODUCTION OF INTERMETALLIC COMPOUND-BASED COMPOSITE MATERIAL

(75) Inventor: Masahiro Kida, Ama-gun (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/863,680

(22) Filed: May 23, 2001

(65) Prior Publication Data

US 2002/0051724 A1 May 2, 2002

(30) Foreign Application Priority Data

May 25, 2000 (JP) ..... 2000-154607
May 18, 2001 (JP) ..... 2001-149499

(51) Int. Cl.[7] ..... B22F 3/26

(52) U.S. Cl. ..... 419/27; 419/10; 419/13; 419/14; 419/19

(58) Field of Search ..... 419/10, 13, 14, 419/19, 27

(56) References Cited

U.S. PATENT DOCUMENTS 5,000,248 A * 3/1991 Newkirk et al. ..... 164/97
5,366,686 A * 11/1994 Mortensen et al. ..... 419/5
5,449,421 A * 9/1995 Hamajima et al. ..... 148/415
5,520,880 A * 5/1996 Johnson et al. ..... 419/45
5,848,349 A * 12/1998 Newkirk et al. ..... 419/10
5,967,400 A * 10/1999 Bell et al. ..... 228/124.5
6,025,065 A * 2/2000 Claussen et al. ..... 428/307.7
6,051,277 A * 4/2000 Claussen et al. ..... 427/376.3
6,322,608 B1 * 11/2001 Haug et al. ..... 75/235

FOREIGN PATENT DOCUMENTS

JP 03-207829 A1 9/1991
JP A-9-227969 9/1997
JP B-2609376 2/1999
JP B-3107563 9/2000

OTHER PUBLICATIONS

I. Horsfall, et al., "*A Process for the Fabrication of Ceramic Fiber Reinforced Titanium Aluminide,*" *Ceramic Engineering and Science Proceedings*, Columbus, US, vol. 13, No. 9/10, Sep. 1, 1992, pp. 605–613, XP000290335.

J. Japan Inst. Metals, vol. 62, No. 6 (1998), pp. 551–556, "Production of $Al/Al_3Ti$ Composites by Low Pressure Casting–Combustion Synthesis Process," Mizuuchi et al.

Powder and Powder Metallurgy, vol. 44, No. 6 pp. 554–559, Feb. 17, 1997, "Consolidation of Titanium Tri–aluminide using by Spark Plasma Sintering," Kobayashi et al.

Materials Science & Engineering, A195 (1995), pp. 113–119, "Processing, microstructure, and properties of co–continuous alumina–aluminum composites," Breslin et al.

* cited by examiner

*Primary Examiner*—Daniel Jenkins
(74) *Attorney, Agent, or Firm*—Burr & Brown

(57) ABSTRACT

There is provided a process for producing an intermetallic compound-based composite material containing a reinforcing material and an intermetallic compound. The process includes infiltrating a metal powder into the gaps of a reinforcing material to form a preform and impregnating the preform with an Al melt to give rise to a spontaneous combustion reaction between the metal powder and the Al melt to convert the Al melt into an aluminide intermetallic compound. The Al melt and the metal powder are used in such amounts that they do not remain after the spontaneous combustion reaction. The process can produce an intermetallic compound-based composite material of large size and complicated shape in reduced steps.

20 Claims, 1 Drawing Sheet

PROCESS FOR PRODUCTION OF INTERMETALLIC COMPOUND-BASED COMPOSITE MATERIAL

BACKGROUND OF THE INVENTION

1. Field of the Invention

The present invention relates to a process for producing an intermetallic compound-based composite material. More particularly, the present invention relates to a process for producing an intermetallic compound-based composite material, which process requires neither pretreatment for forming an intermetallic compound nor high-temperature/high-pressure conditions for forming a composite material from the matrix (the intermetallic compound) and a reinforcing material.

2. Description of Related Art

Composite materials are a macroscopic mixture of a plurality of materials, in which the mechanical properties of individual materials act synergistically and thereby properties not achievable with each single material alone have been made possible. Composite materials can be obtained by combining different materials according to various methods, and a number of material combinations are possible depending upon the kinds of matrix and reinforcing material used, the intended application, the intended cost, etc.

Among composite materials, metal-based composite materials or intermetallic compound-based composite materials are composite materials obtained by reinforcing a matrix, i.e. a metal (e.g. Al, Ti, Ni or Nb) or an intermetallic compound (e.g. TiAl, $Ti_3Al$, $Al_3Ti$, NiAl, $Ni_3Al$, $Ni_2Al_3$, $Al_3Ni$, $Nb_3Al$, $Nb_2Al$ or $Al_3Nb$), with an inorganic material (e.g. a ceramic). These metal-based composite materials or intermetallic compound-based composite materials are lightweight and have a high strength and, therefore, find wide applications in space, aviation and other fields.

Generally, an intermetallic compound-based composite material has characteristic features that it is superior in the thermal characteristics, and abrasive resistance characteristics derived from the mechanical and physical characteristics of the matrix. Typically, intermetallic compound-based composites have a defect of being inferior in fracture toughness compared with a metal-based composite material. Furthermore, intermetallic compound-based composites have a lower coefficient of thermal expansion and a high stiffness.

For producing an intermetallic compound-based composite material, there has been known a process which includes first producing an intermetallic compound powder by mechanical alloying or the like and subjecting the intermetallic compound and a reinforcing material (e.g. a fiber and/or particles), to hot press (HP) or hot isostatic press (HIP) under high-temperature and high-pressure conditions. Also for producing a metal-based composite material, there can be mentioned a process requiring a high pressure, such as impregnation under pressure, melt forging or the like.

Conventional processes for producing an intermetallic compound-based composite material have the following problems. That is, in order to produce an intermetallic compound-based composite material of sufficient density, it is necessary to apply a high temperature and a high pressure by HP, HIP or the like to obtain a sintered intermetallic compound. Therefore, a pretreatment step for formation of the intermetallic compound is necessary and, moreover, there are limitations to the capability and size of the production apparatuses used, which make it very difficult to produce a composite material of large size or complicated shape. Further, near-net shaping is impossible and a machining treatment is necessary in the later step.

Furthermore, since there is required, as the pretreatment step, synthesis of an intermetallic compound by MA or the like, production steps are many and complicated.

Thus, in conventional processes for producing an intermetallic compound-based composite material, a number of steps are necessary and, moreover, a high temperature and a high pressure are employed; therefore, conventional processes are costly.

JP-B-2,609,376 and JP-A-9-227969 and the like propose a method for producing a composite material to produce in situ an aluminide intermetallic compound, and its oxides, especially alumina in a surface layer of a preform comprising metal oxides and the like being reducible with Al and the like by subjecting the preform to reaction with a liquefied Al and the like on said surface layer in order to the solve the above-mentioned problems.

However, in the case of the methods disclosed JP-B-2,609,376 and JP-A-9-227969, the design of the objective composite materials is restricted within the specific combination of the starting materials due the reinforcing materials to be dispersed in the objective composite material are restricted to the specific ones. Thus, it is difficult to modify the characteristic features of the composite materials by changing the combination of the starting materials. Furthermore, those methods have the problem in that metal oxides or the like, or Al or the like remains without reacting if the amounts of the starting materials are not strictly controlled. Moreover, it often becomes impossible to control the reaction since a large amount of the heat of the reaction is generated within instantly.

Incidentally, JP-B-3,107,563 discloses a method for producing a metal-based composite material which comprises forming a preform from fine particles of the reinforcing material and fine particles of Ti and the like having gettering effects of oxygen and nitrogen, and then immersing thus formed preform into Al melt and the like, thereby matrix made of Al and the like is formed.

However, in the case of the method disclosed in JP-B-3,107,563, the form of the produced composite material is restrictive due to the limitation of the production equipment since the preform should be retained in a metal melt to form the matrix therefrom for a predetermined period of time. Indeed, the composite materials producible are limited to a metal-based composite material in which a metal is used to form a matrix.

SUMMARY OF THE INVENTION

In view of the above-mentioned problems of the prior art, the present invention aims at providing a process for producing an intermetallic compound-based composite material of large size or complicated shape in reduced steps.

According to the present invention there is provided a process for producing an intermetallic compound-based composite material comprising a reinforcing material and an intermetallic compound, which includes mixing a metal powder with a reinforcing material to obtain a mixed powder, and placing the thus obtained mixed powder into a vessel. Al is placed an upper side of the mixed powder in the vessel, and the mixed powder is impregnated with an Al melt to give rise to a spontaneous combustion reaction between the metal powder and the Al melt to convert the Al melt into an aluminide intermetallic compound. The Al melt and the metal powder are used respectively in such amounts that a mass ratio of a remaining Al after the spontaneous reaction to the intermetallic compound-based composite material is within a range from 0:10 to 3:7.

According to the present invention, it is preferable to use Ti as a metal powder, and is preferable to mix Ti and Al in a relative mass ratio of 1:0.34 to 1:0.57, taking the mass of Al as 1.0.

According to the present invention, it is also preferable to use Ni as a metal powder, and is preferable to mix Ni and Al in a relative mass ratio of 1:0.47 to 1:0.72, taking the mass of Al as 1.0.

According to the present invention, it is also preferable to use Nb as a metal powder, and is preferable to mix Nb and Al in a relative mass ratio of 1:0.75 to 1:1.13, taking the mass of Al as 1.0.

In the present invention, it is preferable to mix a metal powder and Al in such amounts that Al does not remain substantially after the spontaneous combustion reaction. It also referable to use Ti as a metal powder and it is preferable to mix Ti with Al in a relative mass ratio of 1:0.57 to 1:6.14, taking the mass of Al as 1.0.

In the present invention, it is also preferable to use Ni as a metal powder, and, it is preferable to mix Ni with Al in a relative mass ratio of 1:0.72 to 1:7.20, taking the mass of Al as 1.0.

In the present invention, it is also preferable to use Nb as a metal powder, and, it is preferable to mix Nb with Al in a relative mass ratio of 1:1.13 to 1:12.16, taking the mass of Al as 1.0.

Furthermore, in the present invention, it is preferable to adjust the volumetric fraction of the reinforcing material in the present intermetallic compound-based composite material is preferably 10 to 70%.

The present invention is also directed to a process for producing an intermetallic compound-based composite material comprising a reinforcing material and an intermetallic compound. The process includes mixing a metal powder and an oxide powder reducible by Al with a reinforcing material to obtain a mixed powder, and placing the thus obtained mixed powder into a vessel. Al is placed on an upper side of the mixed powder in the vessel, and the mixed powder is impregnated with an Al melt to give rise to a spontaneous combustion reaction between the metal powder and the Al melt to convert the Al melt into an aluminide intermetallic compound. The Al, the metal powder and the oxide powder are used respectively in such amounts that a mass ratio of a remaining Al after the spontaneous combustion reaction to the intermetallic compound-based composite material is within a range from 0:10 to 3:7.

In this embodiment of the present invention, it is preferable to use Al, the metal powder and the oxide powder in such an amount that the Al, the metal powder and the oxide powder does not remain after the spontaneous combustion reaction. It is preferable to adjust the volumetric fraction of the reinforcing material in the present intermetallic compound-based composite material is preferably 10 to 70%.

In the present invention, the reinforcing material is preferably an inorganic material having a fibrous, particulate or whisker shape, and the reinforcing material is preferably any of $Al_2O_3$, AlN, SiC and $Si_3N_4$.

Further, in the present invention, it is preferable to use a metal powder having an average particle diameter of 5 to 80% of an average particle diameter of a reinforcing material.

DETAILED DESCRIPTION OF THE INVENTION

Figure 1:
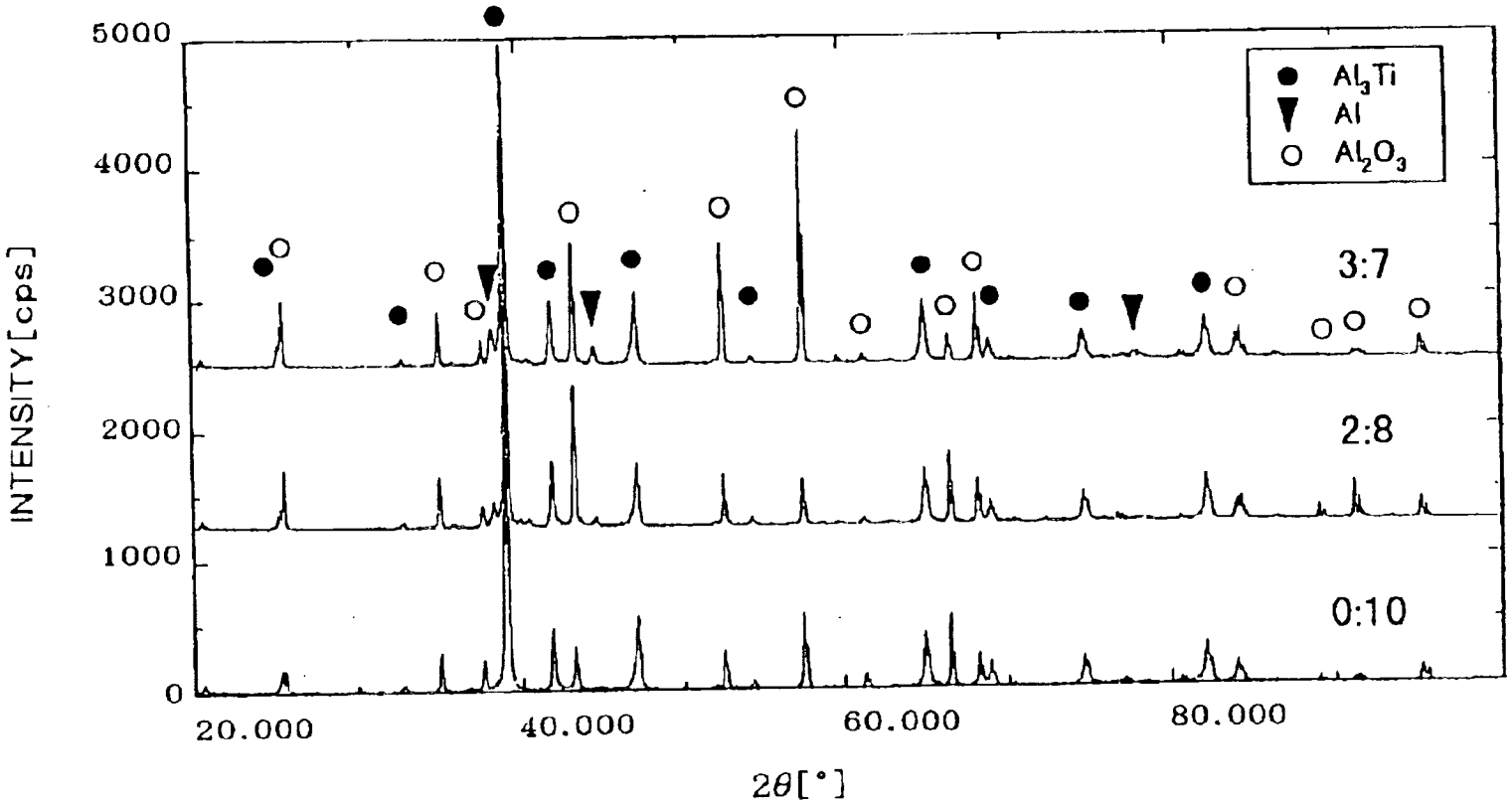
FIG. 1 shows a chart of the respective XRD analyses of intermetallic compound-based composite materials having a mass ratio of Al to aluminide intermetallic compound of 0:10, 2:8, and 3:7, respectively.

The embodiments of the present invention are described in detail below. However, the present invention is not restricted to these embodiments.

Firstly, the first embodiment of the present will be explained below. This embodiment of the present invention is directed to a process for producing an intermetallic compound-based composite material comprising a reinforcing material and an intermetallic compound. In the present process, a metal powder is admixed in advance with a reinforcing material to form a mixed powder. The mixed powder is placed into a vessel having an appropriate shape, then Al is placed on an upper portion of the mixed powder, and melted to make an Al melt, which penetrates into gaps of the mixed powder that can be considered to be a porous body. A spontaneous combustion reaction starts to produce an aluminide intermetallic compound as a result of in-situ synthesis. That is, Al is converted into the aluminide intermetallic compound, and the formed compound forms a matrix, thereby an intended intermetallic compound-based composite material is produced.

In the present process, it is preferable to use a metal powder and Al respectively in such amounts that a remaining Al after reaction is within a range of from 0:10 to 3:7 in terms of the mass ratio to the aluminide intermetallic compound. In the case of the present embodiment, no pretreatment for forming the above intermetallic compound is required; therefore, an intermetallic compound-based composite material can be produced in reduced steps and in a reduced cost. Furthermore, one may produce an intermetallic compound-based composite material having an excellent fracture toughness by leaving unreacted Al within the matrix formed of aluminide intermetallic compound.

It is not preferred to use a metal powder and Al in such amounts that the remaining Al after the reaction exceeds the value of 3:7 in terms of the mass ratio to the aluminide intermetallic compound. This is because the decrease in the attractiveness as a high stiff material due to the reduction in Young's modulus. Moreover, it is not preferable because the reduction in the mechanical strength is apt to occur at around the melting point of Al while the fracture toughness increases. It is preferable to use a metal powder and Al in such amounts that the remaining Al after reaction is within a range of from 0:10 to 2:8 in terms of the mass ratio to the aluminide intermetallic compound, in order to obtain an intermetallic compound-based composite material having well-balanced fracture toughness and mechanical strength.

Furthermore, in the present process, the heat generated by the spontaneous combustion reaction between the Al melt and the metal powder promotes the formation of an aluminide intermetallic compound; therefore, the intermetallic compound-based composite material can be produced at low temperatures. Furthermore, no high pressure (e.g. HP or HIP) used in conventional processes is required and thereby an intermetallic compound-based composite material can be produced by impregnation under no pressure application. As a result, it is possible to produce, for example, an intermetallic compound-based composite material having a relatively large size or a complicated shape, which has been difficult to produce by conventional processes owing to the limited capability of the production apparatus used.

Moreover, in the present process, the inside of the reaction system is kept at high temperatures momentarily owing to the spontaneous combustion reaction between the Al melt and the metal powder; therefore, the Al melt is impregnated into the gaps of the reinforcing material under no pressure application while the Al melt gives rise to a spontaneous combustion reaction, and there can be produced a dense intermetallic compound-based composite material without applying a high pressure.

In the present specification, the expression "the remaining Al after reaction is 0:10 in terms of the mass ratio to the aluminide intermetallic compound" means the state that the unreacted Al does not remain in the formed matrix in the substantial amount. Therefore, note that this expression encompasses the state that Al may remain in such an amount that the physical properties of the remaining Al does not reflect on the properties of the produced intermetallic compound-based composite material.

In the present invention, the metal powder is preferably any of Ti, Ni and Nb. When Al melt is impregnated into the microspaces of a mixture powder, the Al melt reacts with the metal powder to form an aluminide intermetallic compound. Representative examples of such a reaction are shown in the following formulas 1 to 3.

$3Al+Ti \rightarrow Al_3Ti: \Delta H_{298}=-146kJ/mol$ ($\Delta H$: heat of reaction generated; an exothermic reaction because $\Delta H<0$) Formula 1

$3Al+Ni \rightarrow Al_3Ni: \Delta H_{298}=-150kJ/mol$ ($\Delta H$: heat of reaction generated; an exothermic reaction because $\Delta H<0$) Formula 2

$3Al+Nb \rightarrow Al_3Nb: \Delta H_{298}=-160kJ/mol$ ($\Delta H$: heat of reaction generated; an exothermic reaction because $\Delta H<0$) Formula 3

As shown in the formulas 1 to 3, these reactions are an exothermic reaction (a spontaneous combustion reaction). The heat generated by this reaction is utilized in the present process for producing an intermetallic compound-based composite material. In the present invention, therefore, the high temperature and high pressure required in conventional HP, etc. is not required, and it is possible to produce, for example, an intermetallic compound-based composite material having a relatively large shape or a complicated shape which has heretofore been unable to produce owing to the limited capability of the production apparatus used.

The present process differs from the methods disclosed in the JP-B-2,609,376 and JP-A-9-227969 in that only the matrix portion is formed in situ, in the case of the present process. Therefore, one may not only freely choose reinforcing material, but also produce any composite material having desirable properties with designing the properties to be produced. Furthermore, one may control easily the heat of reaction at a predetermined level, by choosing arbitrarily the kinds and the amounts of the reinforcing materials according to the designed properties. Thus, the present process may be applicable in an industrial scale.

In the case that Ti is used as a metal powder which gives rise to a spontaneous combustion reaction with the Al melt, it is preferable to mix Ti and Al in a relative mass ratio of 1:0.34 to 1:0.57, taking the mass of Al as 1.0. By using this mixing ratio, one may obtain an intermetallic compound-based composite material having the mass ratio of the remaining Al after the spontaneous reaction to the intermetallic compound-based composite material being within a range from 0:10 to 3:7.

In the case that Ni is used as a metal powder which gives rise to a spontaneous combustion reaction with the Al melt, it is preferable to mix Ni and Al in a relative mass ratio of 1:0.47 to 1:0.72, taking the mass of Al as 1.0. By using this mixing ratio, one may obtain an intermetallic compound-based composite material having the mass ratio of the remaining Al after the spontaneous reaction to the intermetallic compound-based composite material being within a range from 0:10 to 3:7.

In the case that Nb is used as a metal powder which gives rise to a spontaneous combustion reaction with the Al melt, it is preferable to mix Nb and Al in a relative mass ratio of 1:0.75 to 1:1.13, taking the mass of Al as 1.0. By using this mixing ratio, one may obtain an intermetallic compound-based composite material having the mass ratio of the remaining Al after the spontaneous reaction to the intermetallic compound-based composite material being within a range from 0:10 to 3:7.

It is preferable to use Al and a metal powder in such proportions that Al does not substantially remain in the matrix of the resulting intermetallic compound-based composite material, in the case of the process for producing an intermetallic compound-based composite material according to the present invention, thereby one may obtain an intermetallic compound-based composite material which does not show such a phenomenon that the mechanical strength is reduced at around the melting point of Al or the like. Accordingly, the resultant product shows an excellent thermal resistance under flexural strength test at a higher temperature of 400° C. which is described later without showing the reduction in the strength, like an intermetallic compound-based composite material in whose matrix Al remains. On the other hand, when Al is left in the matrix, one may obtain an intermetallic compound-based composite material having an increased fracture toughness because the brittle feature of the intermetallic compound-based composite material, which is well-known as one of drawbacks thereof, is improved by the remaining Al acting as a ductile phase therein. The thermal resistance is lowered, as is discussed previously, though. Therefore, an intermetallic compound-based composite material having superior characteristics such as mechanical strength and the like can be produced by compounding Al into a metal powder within the ratios mentioned previously.

When Ti is used as the metal powder which gives rise to a spontaneous combustion reaction with the Al melt, it is preferable to use Al and Ti in a relative mass ratio of 1:0.57 to 1:6.14, taking the mass ratio of Al as 1 to produce an aluminide intermetallic compound-based composite material. By using the above ratio to produce an aluminide intermetallic compound-based composite material, all of the matrix of the composite material can be converted from low-melting Al to a high-melting aluminide intermetallic compound. Thus, it becomes unnecessary to beforehand form the above aluminide intermetallic compound and further it becomes possible to produce an intermetallic compound-based composite material which shows, for example, no reduction in strength at around the melting point of Al.

When Ni is used as the metal powder which gives rise to a spontaneous combustion reaction with the Al melt, it is preferable to use Al and Ni in a relative mass ratio of 1:0.72 to 1:7.20, taking the mass of Al as 1 to produce an aluminide intermetallic compound-based composite material. By using the above ratio to produce an aluminide intermetallic compound-based composite material, all of the matrix of the composite material can be converted from low-melting Al to a high-melting aluminide intermetallic compound. Thus, it becomes unnecessary to beforehand form the above aluminide intermetallic compound and further it becomes possible to produce an intermetallic compound-based composite material which shows, for example, no reduction in strength at around the melting point of Al.

When Nb is used as the metal powder which gives rise to a spontaneous combustion reaction with the Al melt, it is preferable to use Al and Nb in a relative mass ratio of 1:1.13 to 1:12.16, taking the mass ratio of Al as 1 to produce an aluminide intermetallic compound-based composite material. By using the above ratio to produce it, all of the matrix of the composite material can be converted from low-melting Al to a high-melting aluminide intermetallic compound, similarly to the above-mentioned cases of using Ti or Ni. Thus, it becomes unnecessary to beforehand form the above aluminide intermetallic compound and further it becomes possible to produce an intermetallic compound-based composite material which shows, for example, no reduction in strength at around the melting point of Al.

Also when a metal powder other than mentioned above is used, by using this metal powder and the Al melt in such a ratio that neither metal powder nor Al melt remains when the Al melt impregnated has been converted into an aluminide intermetallic compound, the matrix of the composite material can be completely converted from low-melting Al to a high-melting aluminide intermetallic compound, similarly to the above-mentioned cases of using Ti, Ni or Nb. Thus, it becomes unnecessary to beforehand form the above aluminide intermetallic compound and further it becomes possible to produce an intermetallic compound-based composite material which shows, for example, no reduction in strength at around the melting point of Al.

An Al material used in carrying out this embodiment of the present process is not restricted to pure Al and an Al alloy may of course be used to obtain the same effect. Further, since the present process can produce an intermetallic compound-based composite material at temperatures lower than the melting point of the formed intermetallic compound, the reaction and/or fusion bonding of the composite material with the vessel to be filled with a mixed powder, the jig or product mold used takes place hardly. Therefore, the releasability of the produced composite material is very good and the present process can be suitably used also for production of an intermetallic compound-based composite material having a complicated shape.

In this embodiment of the present process, it is preferable to use a reinforcing material in such an amount that the volumetric fraction of the reinforcing material in intermetallic compound-based composite material as a final product becomes preferably 10 to 70% by volume, more preferably 30 to 60% by volume. When the volumetric fraction of the reinforcing material is below 10%, the resulting composite material is unable to have a sufficient strength. When the volumetric fraction thereof exceeds 70% by volume, the impregnation of Al melt into reinforcing material is unsatisfactory and the synthesis of aluminide intermetallic compound becomes insufficient. Therefore, the present invention can be preferably utilized when the content of the reinforcing material is at a level used in ordinary intermetallic compound-based composite materials.

The second embodiment of the present invention will be described in detail hereinbelow. This second embodiment is also directed to a process for producing an intermetallic compound-based composite material comprising a reinforcing material and an intermetallic compound, like the first embodiment. This process comprises mixing a metal powder and an oxide powder reducible by Al with a reinforcing material to obtain a mixed powder. The thus obtained mixed powder is placed into a vessel, and Al is put on an upper side of the mixed powder in the vessel. The mixed powder is impregnated with an Al melt to give rise to a spontaneous combustion reaction between the metal powder and the Al melt to convert the Al melt in situ into an aluminide intermetallic compound. In this case, Al is converted into a desired aluminide intermetallic compound to form the matrix metal. There is in this embodiment no necessity of forming an intermetallic compound in advance, like the process of the first embodiment of the present process wherein only a metal powder is mixed with a reinforcing material. Thus, the number of the steps in the production process and the production cost can be reduced.

An oxide powder is reduced to a metal at the time when Al is melted and impregnated into the mixed powder in the vessel. Thus formed metal reacts with Al to form an aluminide intermetallic compound as a matrix. Al that reduced the oxide is converted into alumina, and dispersed within the matrix. Therefore, it becomes possible to produce with great easiness a composite material containing the reinforcing material in a high volumetric ratio, according to this embodiment. The following reaction scheme (4) is given to show an example of such a reaction:

$$3TiO_2+13Al \rightarrow 2Al_2O_3+3Al_3Ti \quad (4).$$

An oxide powder usable in the present embodiment is not restricted to $TiO_2$, and may be any oxide as far as the oxide is reducible with Al. A preferable exemplary oxide may include $TiO_2$, TiO, CaO, $Cr_2O_3$, CuO, $Cu_2O$, CoO, $Co_2O_3$, FeO, $Fe_2O_3$, $Fe_3O_3$, $HfO_2$, $Li_2O$, MnO, MgO, $MoO_3$, $Na_2O$, $Nb_2O$, $Nb_2O_5$, NiO, $SiO_2$, $V_2O_3$, $WO_3$, $Y_2O_3$, $ZrO_2$, mullite, spinel, zirconates, titanates, minerals containing Fe, Ti, Co, Ni, Zr, Si, Nb and the like.

Al, a metal powder, and an oxide powder are mixed to give a mixed powder by using them respectively in such amounts that a mass ratio of a remaining Al in the matrix after the spontaneous combustion reaction is within a range from 0:10 to 3:7 in terms of the mass ratio to the aluminide intermetallic compound. In the case of the present embodiment, no pretreatment for forming the above intermetallic compound is required; therefore, an intermetallic compound-based composite material can be produced in reduced steps and in a reduced cost. Furthermore, one may produce an intermetallic compound-based composite material having an excellent fracture toughness by leaving unreacted Al within the matrix formed of aluminide intermetallic compound.

It is not preferred to use a metal powder and Al in such amounts that the remaining Al after reaction exceeds the value of 3:7 in terms of the mass ratio to the aluminide intermetallic compound. This is because the attractiveness as a high stiff material decreases due to the reduction in Young's modulus. Moreover, the reduction in the mechanical strength is apt to occur at around the melting point of Al while the fracture toughness increases. Thus, it is preferable to use a metal powder and Al in such amounts that the remaining Al after reaction is within a range of from 0:10 to 2:8 in terms of the mass ratio to the aluminide intermetallic compound, in order to obtain an intermetallic compound-based composite material having well-balanced fracture toughness and mechanical strength.

In the present process for producing an intermetallic compound-based composite material, it is preferred to use Al and a metal powder (e.g. Ti, Ni or Nb) in such proportions that Al does not substantially remain in the matrix of the resulting intermetallic compound-based composite material, thereby one may produce the intermetallic compound-based composite material showing no reduction in the mechanical strength even at around the melting point of Al.

In this embodiment of the present process, it is preferable to use a reinforcing material in such an amount that the volumetric fraction of the reinforcing material in intermetallic compound-based composite material as a final product becomes preferably 10 to 70% by volume, more preferably 30 to 60% by volume. When the volumetric fraction of the reinforcing material is below 10%, the resulting composite material is unable to have a sufficient strength. When the volumetric fraction thereof exceeds 70% by volume, the impregnation of Al melt into reinforcing material is unsatisfactory and the synthesis of aluminide intermetallic compound becomes insufficient. Therefore, according to this embodiment of the present invention, one may obtain an intermetallic compound-based composite material containing the reinforcing material in a higher volumetric content.

Next, an example of the present process is described to explain the present invention in detail. There are used, as a reinforcing material, $Al_2O_3$ particles, AlN particles, SiC particles or $Si_3N_4$ particles (all of these particles have a given average particle diameter and are ground particles); as a metal powder, Ti, Ni or Nb all having a given average particle diameter; as a metal impregnated into the preform, Al. The average particle diameter of the metal powder is preferably 5 to 80%, more preferably 10 to 60% of the average particle diameter of the reinforcing material. When the average particle diameter of the metal powder is below 5% of the average particle diameter of the reinforcing material, such a metal powder is difficult to procure and there is a risk of dust explosion, requiring a special care in handling of the metal powder. When the average particle diameter of the metal powder exceeds 80%, the activity required for spontaneous combustion reaction does not reach a sufficient level and it is impossible to produce a dense intermetallic compound-based composite material.

The average particle diameter of the metal powder used for giving rise to a spontaneous combustion reaction with Al is preferably 2 to 40 $\mu$m, more preferably 5 to 30 $\mu$m when the particle diameter of the reinforcing material is, for example, 50 $\mu$m. When the average particle diameter of the metal powder is less than 2 $\mu$m, such a metal powder is difficult to procure and inconvenient to handle. When the average particle diameter is more than 40 $\mu$m, such a metal powder gives rise to a spontaneous combustion reaction with the Al melt, but it is impossible to produce a dense intermetallic compound-based composite material.

Al used for the impregnation and the metal powder are weighed so that they can form an aluminide intermetallic compound having a composition shown in Table 2. As to the aluminide intermetallic compound formed, for example, an Ti-Al intermetallic compound, there exist three representative phases of $Al_3Ti$, TiAl and $Ti_3Al$ and one to three of these phases are formed; therefore, a desired intermetallic compound (matrix) phase can be selected depending upon the properties required for the composite material to be produced. By reacting the Al melt and the metal powder in proportions shown in Table 1, the matrix of composite material can be completely converted from low-melting Al into a high-melting aluminide intermetallic compound. Thus, it becomes unnecessary to beforehand form the above aluminide intermetallic compound and further it becomes possible to produce an intermetallic compound-based composite material which shows, for example, no reduction in strength at around the melting point of Al. Incidentally, the conversion of Al into aluminide intermetallic compound by spontaneous combustion reaction is acceptable if the resulting composite material shows no property deterioration (e.g., no reduction in strength) caused by the presence of a microscopic amount of residual Al. Specifically, the conversion is acceptable if the resulting composite material shows no peak of residual Al by X-ray diffraction or thermal analysis using DTA described later or the like, or only unavoidably remained negligible amount of Al is observed in the resulting composite material.

TABLE 1

| Combination Of materials | Intermetallic compound phase | Melting point (° C.) | Al content (wt. %) |
|---|---|---|---|
| Al—Ti | $Al_3Ti$ | 1350 | 62.5–63.5 |
| | TiAl | 1480 | 34–56.2 |
| | $Ti_3Al$ | 1180 | 14–23 |
| Al—Ni | $Al_3Ni$ | 854 | 58 |
| | $Ni_2Al_3$ | 1133 | 40–44.7 |
| | NiAl | 1638 | 23.5–36 |
| | $Ni_3Al$ | 1385 | 12.2–15 |
| Al—Nb | $Al_3Nb$ | 1680 | 45–47 |
| | $Nb_2Al$ | 1940 | 12–17 |
| | $Nb_3Al$ | 2060 | 7.6–8.8 |

In the present invention, preferred as the reinforcing material is an inorganic material having a fibrous, particulate or whisker shape. By using an inorganic material having such a shape, an intermetallic compound-based composite material can be produced which has a strength and other characteristics meeting the intended application of final product. As a matter of course, the reinforcing material usable in the present invention is not restricted to such an inorganic material.

In the present specification, the expression "a reinforcing material having an average particle size of 10 to 150 $\mu$m" means a granular reinforcing material having an average particle size of 10 to 150 $\mu$m when the reinforcing material is granular, and when the reinforcing material is fibers, whiskers or the like, said expression covers either one having fiber diameter of 0.1 to 30 $\mu$m in the case that the ratio between the length of fiber and fiber diameter is below 150, or one having a fiber diameter of 0.5 to 500 $\mu$m in the case that the ratio between the length of fiber and fiber diameter is 150 or more.

In the present invention, the inorganic material is preferably any of $Al_2O_3$, AlN, SiC and $Si_3N_4$. An intermetallic compound-based composite material shows different properties depending upon the combination of the intermetallic compound and reinforcing material used therein. Therefore, by combining an intermetallic compound with the above-mentioned inorganic material, it is possible to produce an intermetallic compound-based composite material suitable for an intended application. In Table 2 are shown the characteristics of some intermetallic compound-based composite materials obtained from combinations of various reinforcing materials (various inorganic materials) and an intermetallic compound. In the present invention, however, other combinations between other reinforcing material and intermetallic compound are possible, of course.

TABLE 2

| Reinforcing Material | Characteristics of intermetallic compound-based composite material produced using the reinforcing material |
|---|---|
| $Al_2O_3$ | High oxidation resistance, high strength, abrasion resistance, & lower coefficient of thermal expansion |
| AlN | High thermal conductivity, high strength, abrasion resistance, & lower coefficient of thermal expansion |

TABLE 2-continued

| Reinforcing Material | Characteristics of intermetallic compound-based composite material produced using the reinforcing material |
|---|---|
| SiC | High thermal conductivity, electrical conductivity, high strength, abrasion resistance, & lower coefficient of thermal expansion |
| $Si_3N_4$ | High strength, abrasion resistance, & lower coefficient of thermal expansion |

A mixed powder of a reinforcing material and a metal powder is filled into a vessel having an appropriate shape, then the filled mixed powder is compacted under a pressure of about 1 MPa to obtain a compact; Al (commercial pure Al) is placed on thus obtained compact. A usable Al is not limited to pure Al alone and may be any Al having a purity of about 90% or more. An Al alloy may also be used. Subsequently, the compact having Al thereon is heated to a temperature being several ten ° C. higher than the melting point of Al, for example, about 700° C. under reduced pressure, for example, vacuum, so as to make molten Al impregnate into the micro-spaces between the starting materials in the compact. The penetration of the molten Al is immediately achieved by virtue of capillary action induced by the spontaneous combustion reaction, thereby a desired intermetallic compound-based composite material is formed.

Al melt may be impregnated into the compacted mixed powder by pouring an Al melt previously prepared topically. However, it is preferable to impregnate a molten Al into the compacted mixed powder by heating the compacted mixed powder and Al placed thereon. This is because the preparatory works for preparing Al melt beforehand and the specific facilities for preparing Al melt as well can be omitted.

A few minutes of heating is sufficient since the formation of the matrix itself is completed within a quite short time. It is preferred to retain the resultant under isothermal conditions or under elevated temperatures in order to homogenize and stabilize the matrix of the resulting intermetallic compound-based composite material after the completion of the spontaneous combustion reaction. A preferable temperature for this retention is from the same temperature as that generated by the spontaneous combustion reaction to a temperature of about 400 to 500° C. higher than the temperature generated by the spontaneous combustion reaction, while it varies, depending upon the kinds of the starting materials. A preferable retention time is from about 1 hour to several hours, depending upon the needs.

The above-described present process for producing an intermetallic compound-based composite material can produce various kinds of intermetallic compound-based composite materials, owing to the features possessed by the process. Further in the present process, an intermetallic compound-based composite material having a large size or a complicated shape can be easily produced and near-net shaping is possible, allowing for elimination of machining treatment in later step. Furthermore in the present invention, no pretreatment step for formation of aluminide intermetallic compound is necessary, making it easy to reduce the production cost of intermetallic compound-based composite material.

EXAMPLES

The present invention was specifically carried out below and the following results were obtained.

(Production of Aluminide Intermetallic Compound-based Composite Materials)

As shown in Table 3, there were prepared, as reinforcing materials, $Al_2O_3$, AlN, SiC and $Si_3N_4$ all being ground particles having an average particle diameter of 47 to 54 μm; as metal powders, Ti, Ni and Nb all having an average particle diameter of 10 to 125 μm; and Al to be impregnated into the compacted mixed powder [commercial pure Al (A1050, purity: >99.5%)]. Next, Al and the respective metal powders were weighed in proportions capable of giving an aluminide intermetallic compound having a composition shown in Table 2. The metal powder and the reinforcing material were mixed so that the volume proportion of the reinforcing material became as shown in Table 3, to obtain a mixed powder. Each of thus prepared mixed powder was filled into a vessel; each of the filled mixed powder was compacted under a pressure of about 1 MPa; Al was placed on the compacted mixed powder. Each of the compacted mixed powder having Al thereon was kept under vacuum for a while, then heated to 700° C. at the same pressure, kept for about 1 hour at the same temperature, and cooled slowly to produce intermetallic compound-based composite materials (sample Nos. 1 to 11) shown in Table 3.

TABLE 3

| Sample No. | Material: Reinforcing material | Material: Metal powder | Particle diameter: Reinforcing material (μm) | Particle diameter: Metal powder (μm) | Volumetric fraction of reinforcing material (vol. %) | Result of synthesis and resulting | Remarks |
|---|---|---|---|---|---|---|---|
| 1 | $Al_2O_3$ | Ti | 47 | 125 | 40 | X | Synthesis was possible but denseness was incomplete. |
| 2 | $Al_2O_3$ | Ti | 47 | 44 | 40 | X | Synthesis was possible but denseness was incomplete. |
| 3 | $Al_2O_3$ | Ti | 47 | 10 | 40 | ○ | — |
| 4 | $Al_2O_3$ | Ti | 47 | 10 | 10 | ○ | — |
| 5 | $Al_2O_3$ | Ti | 47 | 10 | 30 | ○ | — |
| 6 | $Al_2O_3$ | Ti | 47 | 10 | 50 | ○ | — |
| 7 | AlN | Ti | 50 | 10 | 40 | ○ | — |
| 8 | SiC | Ti | 54 | 10 | 40 | ○ | — |
| 9 | $Si_3N_4$ | Ti | 47 | 10 | 40 | ○ | — |

TABLE 3-continued

| Sample No. | Material: Reinforcing material | Material: Metal powder | Particle diameter: Reinforcing material (μm) | Particle diameter: Metal powder (μm) | Volumetric fraction of reinforcing material (vol. %) | Result of synthesis and resulting | Remarks |
|---|---|---|---|---|---|---|---|
| 10 | $Al_2O_3$ | Ni | 47 | 10 | 40 | ○ | — |
| 11 | $Al_2O_3$ | Nb | 47 | 20 | 40 | ○ | — |

Impregnation conditions
Impregnating material: pure Al (A1050)
Impregnation temperature: 700° C.

(Synthesis Result and Analysis of Denseness)

Test pieces were cut out from the aluminide intermetallic compound-based composite materials produced above and subjected to SEM observation, etc. to analyze the denseness of each composite material. The results are shown in Table 3. Each test piece was subjected also to thermal analysis. As a result, in the sample Nos. 1 to 11 produced according to the present process, there was no endothermic reaction associated with the dissolution of Al and only the peak by the synthesized aluminide intermetallic compound was measured. That is, it was confirmed that the whole matrix was completely converted from Al into an aluminide intermetallic compound by an exothermic reaction. When the particle diameter of Ti powder mixed with $Al_2O_3$ powder (reinforcing material) was varied, synthesis of aluminide intermetallic compound was possible but the resulting matrix was not dense, when the particle diameter of Ti powder was 125 μm and 44 μm (sample Nos. 1 and 2). Therefore, it was confirmed that in order to convert the whole matrix into an aluminide intermetallic compound, the particle diameter of the Ti powder used needs to be smaller than that of the reinforcing material used. This is considered to be because as the particle diameter of metal powder is smaller than the particle diameter of reinforcing material, the specific surface area of the metal powder increases and the activity of spontaneous combustion reaction is enhanced. The method of the thermal analysis is described below.

(Thermal Analysis)

The thermal analysis is carried out using a differential thermobalance apparatus TG-DTA (Model TG8120, a product of Rigaku) in an inert gas atmosphere.

(Production of Aluminide (Al—Ti) Intermetallic Compound-based Composite Materials)

As shown in Table 4, there were prepared an $Al_2O_3$ reinforcing material (ground particles having an average particle diameter of 47 μm), a Ti metal powder having an average particle diameter of 10 μm, and Al to be impregnated into the gaps of the reinforcing material [commercial pure Al (Al050, purity: >99.5%)]. Next, the amount of Al to be impregnated was varied in a range of 20 to 80% by weight, and intermetallic compound-based composite materials (Sample Nos. 12 to 22) shown in Table 4 were produced under the same conditions as mentioned for the sample Nos. 1 to 12.

TABLE 4

| Sample No. | Material: Reinforcing material | Material: Metal powder | Particle diameter: Reinforcing material (μm) | Particle diameter: Metal powder (μm) | Amount of Al impregnated (mass %) | 400° C. bending strength (MPa) | Remarks |
|---|---|---|---|---|---|---|---|
| 12 | $Al_2O_3$ | Ti | 47 | 10 | 82 | 83 | $Al_3Ti$ + Al(Al remained.) |
| 13 | $Al_2O_3$ | Ti | 47 | 10 | 74 | 151 | $Al_3Ti$ + Al(Al remained.) |
| 14 | $Al_2O_3$ | Ti | 47 | 10 | 71 | 178 | $Al_3Ti$ + Al(Al remained.) |
| 15 | $Al_2O_3$ | Ti | 47 | 10 | 67 | 196 | $Al_3Ti$ + Al(Al remained.) |
| 16 | $Al_2O_3$ | Ti | 47 | 10 | 63 | >200 | $Al_3Ti$ |
| 17 | $Al_2O_3$ | Ti | 47 | 10 | 62 | >200 | $TiAl_2$ + $Al_3Ti$ |
| 18 | $Al_2O_3$ | Ti | 47 | 10 | 61 | >200 | $TiAl_2$ + $Al_3Ti$ |
| 19 | $Al_2O_3$ | Ti | 47 | 10 | 50 | >200 | TiAl + $TiAl_2$ |
| 20 | $Al_2O_3$ | Ti | 47 | 10 | 40 | >200 | TiAl |
| 21 | $Al_2O_3$ | Ti | 47 | 10 | 30 | >200 | $Ti_3Al$ + TiAl |
| 22 | $Al_2O_3$ | Ti | 47 | 10 | 20 | >200 | $Ti_3Al$ |
| Comp. Ex. 1 | — | — | — | — | | <50 | Commercial Materials (2000, 6000, 7000, etc.) |

Impregnation conditions
Impregnating material: pure Al (Al050)
Impregnation temperature: 700° C.

(Synthesis Result and Measurement of High-temperature Bending Strength)

Test pieces were cut out from the aluminide intermetallic compound-based composite materials produced above and subjected to thermal analysis in an inert gas atmosphere, using a differential thermobalance apparatus TG-DTA (Model TG8120, a product of Rigaku). In the sample Nos. 16 to 22 produced according to the present process (the amount of the Al impregnated was 20 to 63% by mass), there was no endothermic reaction associated with the dissolution of Al and only the peak by the synthesized aluminide intermetallic compound was measured. That is, it was confirmed that the whole matrix was completely converted from Al into an aluminide intermetallic compound by an exothermic reaction. In contrast, in the sample Nos. 12 to 15 wherein the amount of the Al melt impregnated was 64 to 80% by mass, there was an endothermic reaction associated with the dissolution of Al and the remaining of Al in matrix was confirmed.

The sample Nos. 12 to 22 and Al alloys (Comparative Example) were subjected to a high-temperature bending strength test of 400° C. The results are shown in Table 4. In any of the sample Nos. 12 to 15 in which Al remained in the matrix, the bending strength was lower than 200 MPa. In contrast, in each of the sample Nos. 16 to 22 produced according to the present process, the bending strength was higher than 200 MPa. The reason is considered to be that the matrix was 100% an aluminide intermetallic compound and it contributed to an increase in high-temperature bending strength.

(Production of Intermetallic Compound-based Composite Materials Using Various Reinforcing Materials)

As shown in Table 5, there were prepared, as reinforcing materials, $Al_2O_3$, AlN, SiC and $Si_3N_4$ all being ground particles having an average particle diameter of 47 to 54 μm; as metal powders, Ti, Ni and Nb all having an average particle diameter of 10 to 125 μm; and Al to be impregnated into the compacted mixed powder [commercial pure Al (Al050, purity: >99.5%)]. Each of Sample Nos. 23 to 34 of aluminide intermetallic compounds having a composition shown in Table 5 was synthesized under the same conditions as those for Sample Nos. 1 to 11, by changing the amounts of Al to be impregnated in a range of 30% to 50% by mass. Furthermore, the amounts of Ti powder and Al were adjusted so as to make the matrix of $Al_3Ti$ phase formed.

A composite material as a Comparative Example 2 was synthesized by using a method capable of producing in situ the reinforcing material and the matrix. That is, a cylindrical shaped compact comprising $TiO_2$ granule of an average particle diameter of 0.6 μm was produced by press-molding under pressure of 300 MPa. Thus formed compact was placed in a vessel for impregnation, and it was heated up to a temperature of 1000° C. After the compact was kept at the same temperature for about 30 minutes, Al melt was applied thereto under pressure of about 30 MPa for the impregnation. The resultant was kept for about 1 hour under the same conditions for acceleration of reaction and homogenization of the tissues formed to give a composite material as Comparative Example 2. The volumetric fraction of the reinforcing material was about 42% by volume.

(Synthesis Results and Determination of Physical Properties)

Each test pieces of samples prepared as mentioned above was cut from the respective samples of the aluminide intermetallic compounds prepared to determine the coefficient of thermal expansion and the thermal conductivity thereof. The results of the determination are shown in Table 5 below together with the results of the synthesis. The method for determining the coefficient of thermal expansion and the thermal conductivity are described below.

(Determination of Coefficient of Thermal Expansion)

The coefficient of thermal expansion is determined by using a thermodilatometer (Manufactured by Max Science: model TD-5000S) in a temperature range from room temperature (25° C.) to a predetermined temperature under argon atmosphere.

(Determination of Thermal Conductivity)

The thermal conductivity is determined according to laser flash method by using a thermal constant measuring apparatus (Manufactured by Shinku Riko: Model TC-5000S) at room temperature (25° C.).

TABLE 5

| | Reinforcing material (Particles) | | | Matel Power | | Physical properties | |
|---|---|---|---|---|---|---|---|
| Sample No. | Kind of Reinforcing material | Particle diameter (μm) | Volumetric fraction of reinforcing material (vol. %) | Kind of metal | Particle diameter (μm) | Coefficient of thermal expansion (ppm/K) | Thermal Conductivity (W/m · K) |
| 23 | $Al_2O_3$ | 47 | 30 | Ti | 10 | 11.1 | 40.2 |
| 24 | $Al_2O_3$ | 47 | 40 | Ti | 10 | 10.4 | 39.4 |
| 25 | $Al_2O_3$ | 47 | 50 | Ti | 10 | 9.9 | 39.1 |
| 26 | SiC | 54 | 30 | Ti | 10 | 8.7 | 56.4 |
| 27 | SiC | 54 | 40 | Ti | 10 | 8.1 | 63.7 |
| 28 | SiC | 54 | 50 | Ti | 10 | 7.6 | 75.5 |
| 29 | AlN | 50 | 30 | Ti | 10 | 9.2 | 77.3 |
| 30 | AlN | 50 | 40 | Ti | 10 | 8.7 | 92.0 |
| 31 | AlN | 50 | 50 | Ti | 10 | 8.3 | 105.1 |
| 32 | $Si_3N_4$ | 47 | 30 | Ti | 10 | 8.8 | 32.2 |
| 33 | $Si_3N_4$ | 47 | 40 | Ti | 10 | 8.0 | 32.0 |
| 34 | $Si_3N_4$ | 47 | 50 | Ti | 10 | 7.3 | 31.5 |
| Comp. Ex. 2 | $Al_2O_3$ | — | 42 | — | — | 10.6 | 31.7 |

As is clear from the results shown in Table 5, the volumetric fraction of the reinforcing material can be controlled to desired level by changing the amounts of the starting materials, in the case of the samples produced according to the present process; only matrix is formed in situ in the case of the present process. On the other hand, the volumetric fraction of the reinforcing material is fixed to a certain level when $Al_2O_3$ was used as a reinforcing material, or the matrix and the reinforcing material were formed in situ, like Comparative Example 2. It becomes clear that one may produce a composite material having a lower coefficient of thermal expansion with employment of SiC, AlN, $Si_3N_4$ as a reinforcing material, preferably with increasing the amount of such a reinforcing material.

When SiC was used as a reinforcing material, the thermal conductivity increased about two time, compared with the case wherein $Al_2O_3$, or $Si_3N_4$ was used. Furthermore, the thermal conductivity was increased three times, when AlN was used, compared with the case wherein $Al_2O_3$, or $Si_3N_4$ was used. Thus, one may form a composite material having desired physical features by changing the kind of the reinforcing material and the volumetric fraction thereof.

[Production of Intermetallic Compound-based Composite Materials Using Oxide Powder]

As shown in Table 6, there were prepared, as a reinforcing material, $Al_2O_3$ being ground particles having an average particle diameter of 47 μm; as a metal powder, Ti having an average particle diameter of 10 μm; as an oxide powder, $TiO_2$ powder having an average particle diameter of 0.6 μm; and Al to be impregnated into the compacted mixed powder [commercial pure Al (Al050, purity: >99.5%)]. The amounts of Ti powder, $TiO_2$ powder, and Al were adjusted so as to make the matrix of $Al_3Ti$ phase formed. Thereafter, $Al_2O_3$ granules were admixed thereto in a such amount that the reinforcing material showed the volumetric fraction shown in Table 6. The resultant was fulfilled into a vessel having a desired shape, then the fulfilled mixture was compacted under pressure of about 1 Mpa. Al was placed on thus compacted mixture. The resultant mixture was left under vacuum for a while, then heated up to a temperature of 700° C. under the same pressure. After keeping the resultant for about 1 hour, it was gradually cooled to room temperature to give the respective Sample Nos. 35 to 39 of intermetallic compound-based composite materials shown in Table 6.

Each test pieces of Samples prepared as mentioned above was cut from the respective samples of the aluminide intermetallic compounds prepared to examine the results of the synthesis and the degree of the denseness thereof. The results thereof are shown in Table 6 below together with the volumetric fraction and the like.

tion of Al. These samples are an intermetallic compound produced without using $TiO_2$ powder.

[Production of Intermetallic Compound-based Composite Materials with Changing Composition of Matrix]

There were prepared, as a reinforcing material, $Al_2O_3$ being ground particles having an average particle diameter of 47 μm; as a metal powder, Ti having an average particle diameter of 10 μm; and Al to be impregnated into a compacted mixed powder [commercial pure Al ($Al_{050}$, purity: >99.5%)]. The amounts of Ti powder and Al were adjusted so as to make the matrix a mixed phase of an intermetallic compound of $Al_3Ti$ phase and a remaining Al/an intermetallic compound of $Al_3Ti$ phase. Thereafter, $Al_2O_3$ granules were admixed thereto in a such amount that the reinforcing material had a volumetric fraction of 40%. The resultant was fulfilled into a vessel having a desired shape, then the fulfilled mixture was compacted under pressure of about 1 Mpa. Al was placed on thus compacted mixture. The resultant mixture was left under atmosphere of 0.00133 Pa. for a while, then heated up to a temperature of 700° C. under the same pressure. After keeping the resultant for about 3 minutes, it was gradually cooled to room temperature to give the respective Sample Nos. 40 to 44 of intermetallic compound-based composite materials shown in Table 7. Furthermore, there were prepared an metal matrix composite material comprising $Al_2O_3$ as a reinforcing material and Al as a matrix, as Comparative Example 2, and an Al alloy (A5050) as Comparative Example 6.

Each sample having a different composition is subjected to XRD analysis to determine the intensity of X ray, and the mass ratio between metal and intermetallic compound of each sample was calculated using the standard curve prepared by plotting the results of XRD analysis on the standard

TABLE 6

| | Reinforcing material (Particles) | | | Matel Powder | | Oxide powder | | | |
|---|---|---|---|---|---|---|---|---|---|
| Sample No. | Kind of Reinforcing material | Particle diameter (μm) | Volumetric fraction of reinforcing material (vol. %) | Kind of metal | Particle diameter (μm) | Kind of oxide | Particle diameter (μm) | Result of synthesis and resulting | Remarks |
| 35 | $Al_2O_3$ | 47 | 30 | Ti | 10 | $TiO_2$ | 0.6 | ◎ | |
| 36 | $Al_2O_3$ | 47 | 40 | Ti | 10 | $TiO_2$ | 0.6 | ◎ | |
| 37 | $Al_2O_3$ | 47 | 50 | Ti | 10 | $TiO_2$ | 0.6 | ◎ | |
| 38 | $Al_2O_3$ | 47 | 60 | Ti | 10 | $TiO_2$ | 0.6 | ◎ | |
| 39 | $Al_2O_3$ | 47 | 70 | Ti | 10 | $TiO_2$ | 0.6 | ◎ | |
| Comp. Ex. 3 | $Al_2O_3$ | 47 | 60 | Ti | 10 | — | — | ○ | Synthesis was possible but denseness was incomplete. |
| Comp. Ex. 4 | $Al_2O_3$ | 47 | 70 | Ti | 10 | — | — | ○ | Synthesis was possible but denseness was incomplete. |

It is confirmed that the whole of the matrix was converted into an intermetallic compound as to the Sample Nos. 35 to 39 produced according to the present process, even in a case that the volumetric fraction of the reinforcing material exceeds 50%. We do not want to be bound to any specific theory, however, it is considered that $Al_2O_3$ formed in situ as a result of the reaction induced by the reduction reaction of $TiO_2$ powder in the micro-spaces between $Al_2O_3$ granules added in advance fulfilled said micro-spaces, and this could be contributed to the improvement in the volumetric fraction of the reinforcing material.

In the case of the samples of Comparative Examples 2 and 3, it has been found that the matrix formed did not become dense due to the unfavorable happenings during impregnasamples whose mass ratio between metal and intermetallic compound has been adjusted to the predetermined levels, respectively. The results thereof are shown in table 7 below. Sample Nos. 41, 42 and 44 were subjected to XRD analysis. The resulting chart thereof is shown in FIG. 1. Note the numerical indications 0:10, 2:8 and 3:7 show the mass ratio between Al and aluminide intermetallic compounds, respectively.

(Determination of Young's Modulus)

The Young's modulus of each sample is determined by four-point bending method according to JIS R 1601, using a sample having a predetermined shape.

TABLE 7

| Sample No. | Reinforcing material Kind | Reinforcing material Particle diameter (μm) | Reinforcing material Volumetric fraction (vol. %) | Matel Powder Kind | Matel Powder Particle diameter (μm) | Amount of Al impregnated (mass %) | Metal: Intermetallic compound (Volumetric ratio) | Coefficient of thermal expansion (ppm/k) | Young's modulus (GPa) | Fracture toughness (MPa · $m^{1/2}$) | Remarks |
|---|---|---|---|---|---|---|---|---|---|---|---|
| 40 | $Al_2O_3$ | 47 | 40 | Ti | 10 | 82 | 5:5 | 14.1 | 139 | 10.3 | $Al_3Ti$ + Al |
| 41 | $Al_2O_3$ | 47 | 40 | Ti | 10 | 74 | 3:7 | 12.3 | 178 | 8.2 | $Al_3Ti$ + Al |
| 42 | $Al_2O_3$ | 47 | 40 | Ti | 10 | 71 | 2:8 | 11.8 | 191 | 6.9 | $Al_3Ti$ + Al |
| 43 | $Al_2O_3$ | 47 | 40 | Ti | 10 | 67 | 1:9 | 11.0 | 203 | 4.8 | $Al_3Ti$ + Al |
| 44 | $Al_2O_3$ | 47 | 40 | Ti | 10 | 63 | 0:10 | 10.4 | 212 | 4.3 | $Al_3Ti$ |
| Comp. Ex. 5 | $Al_2O_3$ | 47 | 40 | — | — | — | — | 16.2 | 120 | 16.3 | $Al_2O_3$/Al composite material |
| Comp. Ex. 6 | — | — | — | — | — | — | — | 27.3 | 71 | 25.4 | Al alloy (A5052) |

It was confirmed that the Sample Nos. 41 to 44 according to the present process shows not only a higher Young's modulus, but also a reduced coefficient of thermal exansion, compared with that of Comparative Example 5 whose matrix is Al. That is, it is preferred to make the whole of the matrix an intermetallic compound in order to obtain a composite material having a high Young's modulus. On the other hand, the fracture toughness increases, as the content of the remaining Al increases. Unfortunately, however, it brings the abrupt drop of Young's modulus drops with increase in coefficient of thermal expansion increase, if the content of the remaining Al increases, like Sample No. 40. Accordingly, it is preferred to choose a proper mass ratio of Al forming the matrix and the intermetallic compound within a range of from 0:10 to 3:7.

The presence of Al in the matrix was confirmed by the appearance of the peak in the chart showing the results of XRD analysis on each sample prepared by changing the mass ratio between Al and aluminide intermetallic compound in a range from 0:10 to 3:7. It has become clear that the formation of the aluminide intermetallic compound as a phase formed after the synthesis and the remaining Al may be also confirmed by XRD analysis, in addition to the thermal analysis using DTA.

According to the present invention, one may produce freely an intermetallic compound-based composite material having a desired ratio between the aluminide intermetallic compound and Al which compose the matrix in the composite material, by adjusting the compounding ratio of Al and Ti.

As described above, according to the present process for producing an intermetallic compound-based composite material, (1) a metal powder mixed with a reinforcing material and (2) an Al melt give rise to a spontaneous combustion reaction; thereby, an intermetallic compound-based composite material can be produced at a low temperature under no pressure application, as compared with conventional production processes. Further, since an aluminide intermetallic compound is synthesized in-situ, a pretreatment step for forming the intermetallic compound can be eliminated. Furthermore, near-net shaping is possible. Thus, reductions in production steps as well as in cost are possible.

What is claimed is:

1. A process for producing an intermetallic compound-based composite material comprising a reinforcing material and an intermetallic compound, comprising the steps of: mixing a metal powder with a reinforcing material to obtain a mixed powder, filling the mixed powder into a vessel, placing Al on an upper side of the mixed powder filled into the vessel, heating the Al and the mixed powder under reduced pressure to a temperature that is several tens of ° C. higher than the melting point Al, and impregnating the mixed powder with an Al melt, wherein a spontaneous combustion reaction between the metal powder and the Al melt to convert the Al melt into an aluminide intermetallic compound, and the Al melt and the metal powder are used respectively in such amounts that a mass ratio of a remaining Al after the spontaneous reaction to the intermetallic compound-based composite material is within a range from 0:10 to 3:7, and wherein reinforcing material particles are dispersed within the intermetallic compound-based composite material.

2. A process for producing an intermetallic compound-based composite material comprising a reinforcing material and an intermetallic compound according to claim 1, wherein Ti powder comprises said metal powder, and Ti powder is mixed with Al in a relative mass ratio of 1:0.34 to 1:0.57, with the mass of Al as 1.0.

3. A process for producing an intermetallic compound-based composite material comprising a reinforcing material and an intermetallic compound according to claim 1, wherein Ni powder comprises said metal powder, and Ni powder is mixed with Al in a relative mass ratio of 1:0.47 to 1:0.72, with the mass of Al as 1.0.

4. A process for producing an intermetallic compound-based composite material comprising a reinforcing material and an intermetallic compound according to claim 1, wherein Nb powder is used as said metal powder, and Nb powder is mixed with Al in a relative mass ratio of 1:0.75 to 1:1.13, with the mass of Al as 1.0.

5. A process for producing an intermetallic compound-based composite material comprising a reinforcing material and an intermetallic compound according to claim 1, wherein said metal powder is mixed with Al in such amounts that Al does not remain substantially after the spontaneous combustion reaction.

6. A process for producing an intermetallic compound-based composite material comprising a reinforcing material and an intermetallic compound according to claim 5, wherein Ti powder comprises said metal powder and is mixed with Al in a relative mass ratio of 1:0.57 to 1:6.14, with the mass of Al as 1.0.

7. A process for producing an intermetallic compound-based composite material comprising a reinforcing material and an intermetallic compound according to claim 5, wherein Ni powder comprises said metal powder is mixed with Al in a relative mass ratio of 1:0.72 to 1:7.20, with the mass of Al as 1.0.

8. A process for producing an intermetallic compound-based composite material comprising a reinforcing material and an intermetallic compound according to claim 5, wherein Nb powder comprises said metal powder is mixed with Al in a relative mass ratio of 1:1.13 to 1:12.16, with the mass of Al as 1.0.

9. A process for producing an intermetallic compound-based composite material comprising a reinforcing material and an intermetallic compound according to claim 1, wherein a volumetric fraction of the reinforcing material in the intermetallic compound-based composite material is adjusted to 10 to 70% by volume.

10. A process for producing an intermetallic compound-based composite material according to claim 1, wherein the reinforcing material is an inorganic material having a shape selected from the group consisting of fibrous shapes, particulate shapes and whisker shapes.

11. A process for producing an intermetallic compound-based composite material according to claim 10, wherein the reinforcing material is at least one member selected from the group consisting of $Al_2O_3$, AlN, SiC and $Si_3N_4$.

12. A process for producing an intermetallic compound-based composite material according to claim 1, wherein the metal powder has an average particle diameter corresponding to 5 to 80% of an average particle diameter of the reinforcing material.

13. A process for producing an intermetallic compound-based composite material comprising a reinforcing material and an intermetallic compound, comprising the steps of: mixing a metal powder and an oxide powder reducible by Al with a reinforcing material to obtain a mixed powder, filling the mixed powder into a vessel, placing Al on an upper side of the mixed powder filled into the vessel, heating the Al and the mixed powder under reduced pressure to a temperature that is several tens of ° C. higher than the melting point Al, and impregnating the mixed powder with an Al melt, wherein a spontaneous combustion reaction between the metal powder and the Al melt converts the Al melt into an aluminide intermetallic compound, and the Al, the metal powder and the oxide powder are used respectively in such amounts that a mass ratio of a remaining Al after the spontaneous reaction to the intermetallic compound-based composite material is within a range from 0:10 to 3:7, and wherein reinforcing material particles are dispersed within the intermetallic compound-based composite material.

14. A process for producing an intermetallic compound-based composite material comprising a reinforcing material and an intermetallic compound according to claim 13, wherein said metal powder is mixed with Al in such amounts that Al does not remain substantially after the spontaneous combustion reaction.

15. A process for producing an intermetallic compound-based composite material comprising a reinforcing material and an intermetallic compound according to claim 13, wherein a volumetric fraction of the reinforcing material in the intermetallic compound-based composite material is adjusted to 10 to 70% by volume.

16. A process for producing an intermetallic compound-based composite material according to claim 13, wherein the reinforcing material is an inorganic material having a shape selected from the group consisting of fibrous shape, particulate shape and whisker shape.

17. A process for producing an intermetallic compound-based composite material according to claim 16, wherein the reinforcing material is at least one member selected from the group consisting of $Al_2O_3$, AlN, SiC and $Si_3N_4$.

18. A process for producing an intermetallic compound-based composite material according to claim 13, wherein the metal powder has an average particle diameter corresponding to 5 to 80% of an average particle diameter of the reinforcing material.

19. A process for producing an intermetallic compound-based composite material according to claim 1, wherein said temperature is at least 700° C.

20. A process for producing an intermetallic compound-based composite material according to claim 13, wherein said temperature is at least 700° C.

* * * * *

UNITED STATES PATENT AND TRADEMARK OFFICE

CERTIFICATE OF CORRECTION

PATENT NO. : 6,852,275 B2
DATED : February 8, 2005
INVENTOR(S) : Masahiro Kida

It is certified that error appears in the above-identified patent and that said Letters Patent is hereby corrected as shown below:

Column 1,
Line 39, please delete "the"

Column 2,
Line 63, please insert --on-- after "placed"

Column 20,
Line 23, please delete "." after "°C"
Line 24, please insert -- of -- after "point"
Line 27, please delete "to"
Line 27, please replace "convert" with -- converts --
Line 30, please insert -- combustion -- after "spontaneous"
Lines 40, 46, 52 and 64, please change "as" to -- being --
Line 50, please change "is used as" to -- comprises --

Column 21,
Lines 1 and 7, please insert -- and -- after second occurrence of "powder"
Lines 3 and 9, please change "as" to -- being --
Line 38, please delete "." after "°C"
Line 38, please add -- of -- after "point"

Column 22,
Line 4, please add -- combustion -- after "spontaneous"

Signed and Sealed this

Tenth Day of May, 2005

JON W. DUDAS
*Director of the United States Patent and Trademark Office*